US006302828B1

(12) United States Patent
Martin et al.

(10) Patent No.: US 6,302,828 B1
(45) Date of Patent: Oct. 16, 2001

(54) WEIGHT OFFLOADING APPARATUS

(75) Inventors: Matthew R. Martin, Remsenberg; James M. Kandora, Port Jefferson Station; Edward B. Behan, Bluepoint, all of NY (US)

(73) Assignee: Biodex Medical Systems, Inc., Shirley, NY (US)

( * ) Notice: Subject to any disclaimer, the term of this patent is extended or adjusted under 35 U.S.C. 154(b) by 0 days.

(21) Appl. No.: 09/493,708

(22) Filed: Jan. 28, 2000

(51) Int. Cl.[7] ..... A63B 23/04
(52) U.S. Cl. ..... 482/69; 482/43; 601/23
(58) Field of Search ..... 482/66, 68, 49, 482/23, 43, 67, 95, 143; 601/23

(56) References Cited

U.S. PATENT DOCUMENTS

| | | | | |
|---|---|---|---|---|
| 4,981,307 | | 1/1991 | Walsh . | |
| 5,181,904 | | 1/1993 | Cook . | |
| 5,526,893 | * | 6/1996 | Higer | 482/68 |
| 5,569,129 | | 10/1996 | Seif-Naraghi . | |
| 5,662,560 | | 9/1997 | Svendsent et al. . | |
| 5,695,432 | | 12/1997 | Soderlund . | |
| 5,704,881 | * | 1/1998 | Dudley | 482/69 |

OTHER PUBLICATIONS

A Treadmill and Harness Support for Evaluation and Rehabilitation Gait, Kathleen E. Norman, BSc, PT, Andre Pepin, MSc, Michel Ladouceur, MSc, Hugues Barbeau, PhD, PT, Arch Phys Rehabil, vol. 76, Aug. 1995.

A New Approach to Retrain Gait in Stroke Patients Through Body Weight Support and Treadmill Stimulation, Martha Visintin, Msc; Hugues Barbeau, PhD; Nicol Korner–Bitensky, PhD; Nancy E. Mayo, PhD, McGill University, School of Physical and Occupational Therapy, 1998.

* cited by examiner

*Primary Examiner*—Glenn E. Richman
(74) *Attorney, Agent, or Firm*—Cobrin & Gittes

(57) ABSTRACT

A transportable offloading weight apparatus for supporting a portion of a patient's weight undergoing gait training is provided. The offloading weight apparatus employs a resilient suspension system to reduce the amount of weight borne by a patient. The offloading weight apparatus includes a frame having a connection linkage, a rope routed in the frame through a pulley system, a resilient cord that is attached to the frame at one end and connected to the connection linkage through one end of the rope, a harness support assembly secured to another end of the rope and a tension adjustor for applying tension to the resilient cord.

37 Claims, 4 Drawing Sheets

WEIGHT OFFLOADING APPARATUS

CROSS-REFERENCE TO RELATED PATENT APPLICATIONS

None

STATEMENT REGARDING FEDERALLY SPONSORED RESEARCH OR DEVELOPMENT

None

BACKGROUND OF THE INVENTION

1. Field of the Invention

The present invention generally relates to a device for offloading a portion of a patient's weight during gait training.

2. Discussion of the Related Art

Partial weight bearing gait training is a method of training and rehabilitating a patient that has completely lost or has suffered a reduced ability to ambulate. During training the weight of the patient is partially supported by an unweighing device. Specifically, the patient is able to undergo physical training such as learning or relearning to walk with the aid of a treadmill without having to support his entire body weight which would otherwise impose a significant obstacle during gait training. As gait training therapy progresses, the amount of body weight that is supported or off weighed may be gradually reduced.

Unweighing body support systems or weight offloading systems are commonly used during locomotion on a treadmill in the treatment of patients with neurological deficits and other clinical conditions such as lower extremity fractures, osteoarthritis, and lower extremity amputations. A patient suffering the effects of neurological trauma or disease that curtails the patient's ability to ambulate bearing his full body weight can gain gait motion with the aid of an unweighing system, assisted or unassisted, in order to retain muscle tone and gain strength. In addition, patients, especially athletes, can resume training earlier that would have been possible without the aid of weight offloading devices.

Weight offloading systems use a variety of methods to support a portion of a patient's body weight. Many systems in use today, employ a harness that is worn by the patient and is connected to overhead cables and/or ropes that apply an upward physical force to reduce a portion of the patient's body weight. In some systems, the supporting cables or ropes are affixed to a framework wherein the frame or a portion of the frame is upwardly adjusted until the force develops in the rope. In other systems, ropes run over a series of pulleys and weights are added to the ropes to develop a tension force in the rope which off loads the weight of the patient. Many of these systems measure the force applied to the patient through the rope or cable, which magnitude of the force is then displayed.

There are several different commercially available weight offloading gait training devices. In some systems, the frame is adjusted upwards to tension a rope that is attached to a harness worn by the patient. In these systems, however, there is no up or down movement without the load varying widely or disappearing. Some systems of this type add springs of various lengths to the rope in order to allow for a small amount of movement, but the load still varies widely, i.e., the movement of the patient will cause a substantial variation in the magnitude of the lifting force applied to the patient. In addition, these units have limited ranges. In other systems the rope is manually pulled. Although such manual systems allow a larger adjustment range, the movement of the patient still presents a loading problem. While other units use weights to adjust the tension in the rope, it is difficult to apply the load, and mobility of the unit is impracticable due to the swinging of the weights and difficulty to push them. Pneumatic units apply a more constant force and have greater ranges, but because such units require an air compressor they are not mobile. In addition to the various drawbacks associated with the particular systems, such systems are generally heavy and expensive.

Other drawbacks of known weight offloading gait training systems include the lack of a place for the therapist to sit while administering gait therapy, lack of accurately reading the unweighing load, frame sizes that do not accommodate a sufficient number of patient sizes. In addition, some available systems are restrictive to the extent a patient cannot easily change directions, and/or are not suitable to aid with assisting a patient out of a wheelchair.

What is needed is an apparatus to offload a portion of a patient's weight during gait training that allows the patient to move up and down during the natural motion of walking and running and still apply a reasonable constant force.

What is also needed is an apparatus to offload a portion of a patient's weight during gait training and catches the patient if there is too much movement or if the patient is unable to support even their reduced weight.

What is also needed is an apparatus to offload a portion of a patient's weight during gait training wherein the force should be relatively easy to apply.

What is further needed is an apparatus to offload a portion of a patient's weight during gait training that is mobile, lightweight and easy for the patient to push so the patient can ambulate over a floor surface.

What is further needed is an apparatus to offload a patient's weight during gait training that enables the patient to reverse his direction easily while pushing the unit without having to turn around a bulky system within a confined space.

Yet another need is an apparatus to offload a patient's weight during gait training allowing the rope a large adjustment range to accommodate different sized patients and having the force on the rope assist the patient rising out of a wheel chair or off a treatment table.

Other features and advantages of the present invention will become apparent from the following detailed description of the invention with reference to the accompanying drawings.

BRIEF SUMMARY OF THE INVENTION

The present invention provides an apparatus for offloading a patient's weight during gait training that comprises any one or a combination of any group of the following items: (i) a frame that is constructed of lightweight materials; (ii) casters that support the frame and aid in the moving of the unit from place to place by rolling; (iii) handles configured to allow a patient to easily push the offloading device; (iv) a single rope arranged to allow a patient to turn completely around during gait training and reverse direction without having to turn the unit around (v) at least one resilient cord arranged so that a patient's upward and downward movements do not cause large load variances; (vi) a crank handle arranged to permit offloading weight to be adjusted up to about 180 lbs. (vii) a body harness that assists a patient to stand upright and out of a wheel chair; (viii) a second crank handle to adjust the height of the harness; ix) hard stops that limits the dynamic motion of the patient to a maximum of four inches in order to prevent the patient from falling; and (x) a seat attachable to the frame that allows the therapist to sit during gait training.

DETAILED DESCRIPTION OF THE INVENTION

Figure 1:
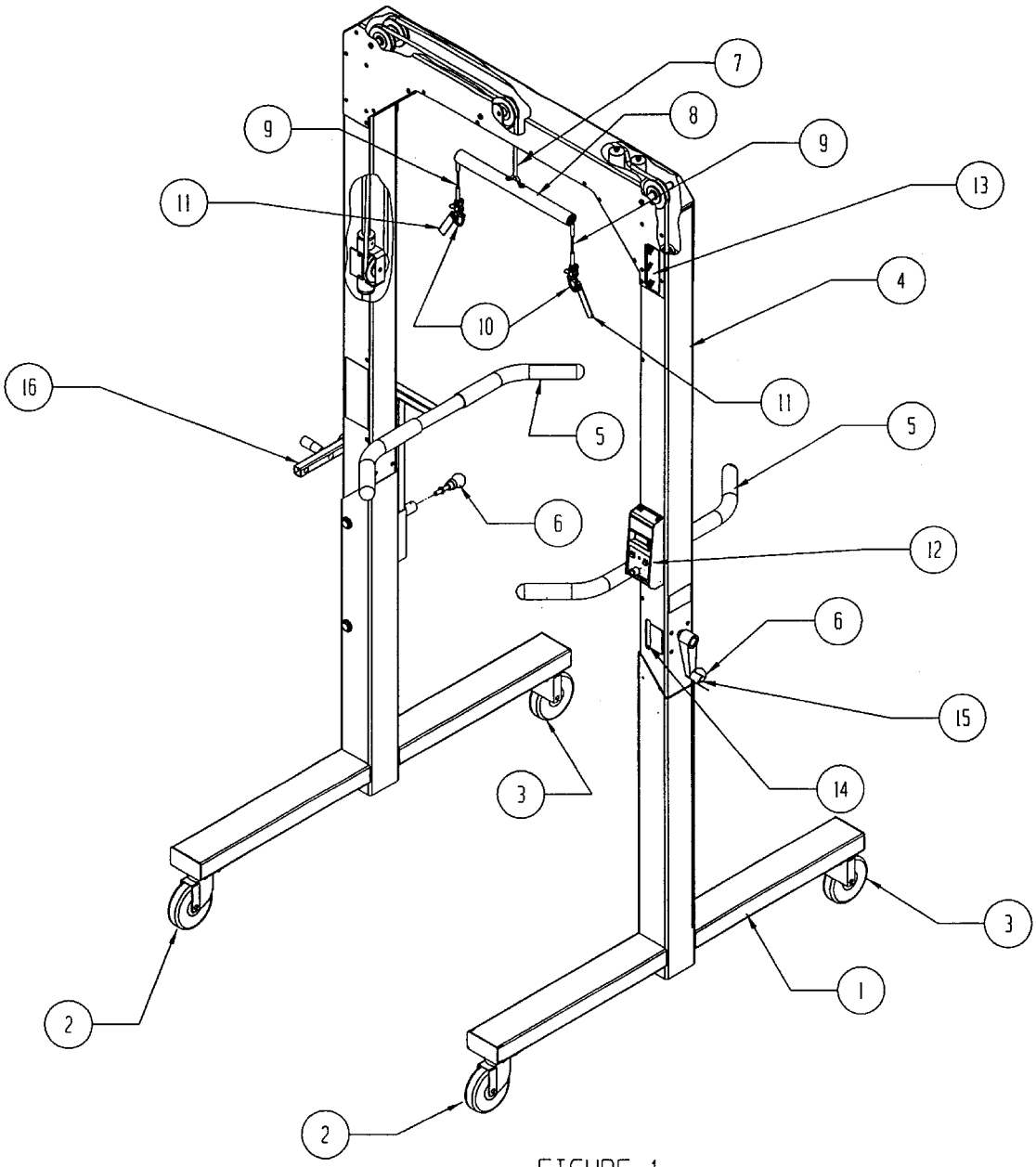
FIG. 1 is an overall view of the weight offloading apparatus showing some internal parts.

In FIG. 1, the weight offloading apparatus or the unweighing apparatus is a gantry type unit that will straddle a patient. The lower legs 1 have large diameter roll locking casters 2,3. One is steerable (2), one is fixed (3). The upper frame 4 is preferably made of lightweight high strength aluminum with removable covers. The upper frame 4 can be affixed to lower legs 1 at a choice of heights, preferably three.

There are two large pushing handles 5 mounted on the lower legs 1 which the patient may use to push the unit along the floor. The pushing handles 5 are preferably of an elongated broken-U shape so that they can be used with the patient facing in either direction. A therapist can also push or pull on the handles to assist the patient. The height of the pushing handles 5 are adjustable by pulling a spring loaded pull pin 6 in each of the handles, adjusting the height of the handles 5 and releasing the pins so that they engage in one of a series of holes in the handles. The pushing handles 5 can also be removed and/or may be configured in other ways well known in the art to allow the handles to be secured on the frame at any of a plurality of locations.

A rope 7 emerges from the center of the top side of the upper frame 4 and is attached to a padded crossbar 8. At the ends of the padded crossbar 8 are cables 9 with a pair of quick release shackles 10 at the termination of the cables 9. The pair of quick release shackles 10 are used to attach a patient harness (not shown) to the unweighing system. The patient harness can be quickly released in an emergency by pulling firmly on release tags 11 on each of the quick release shackles 10. The quick release shackles 10 open to release the harness.

Mounted on the upper frame 4 is a battery operated load display 12. The load display 12 reads the unweighing load on the rope 7. The upper frame 4 also has a stop indicator window 13 and an approximate unweighing load window 14. These windows are used to view indicators within the frame. An unweighing load crank handle 15 is used to adjust the magnitude of the unweighing load. A height adjusting rotating crank handle 16 is used to adjust the vertical height of the padded crossbar 8.

Figure 2:
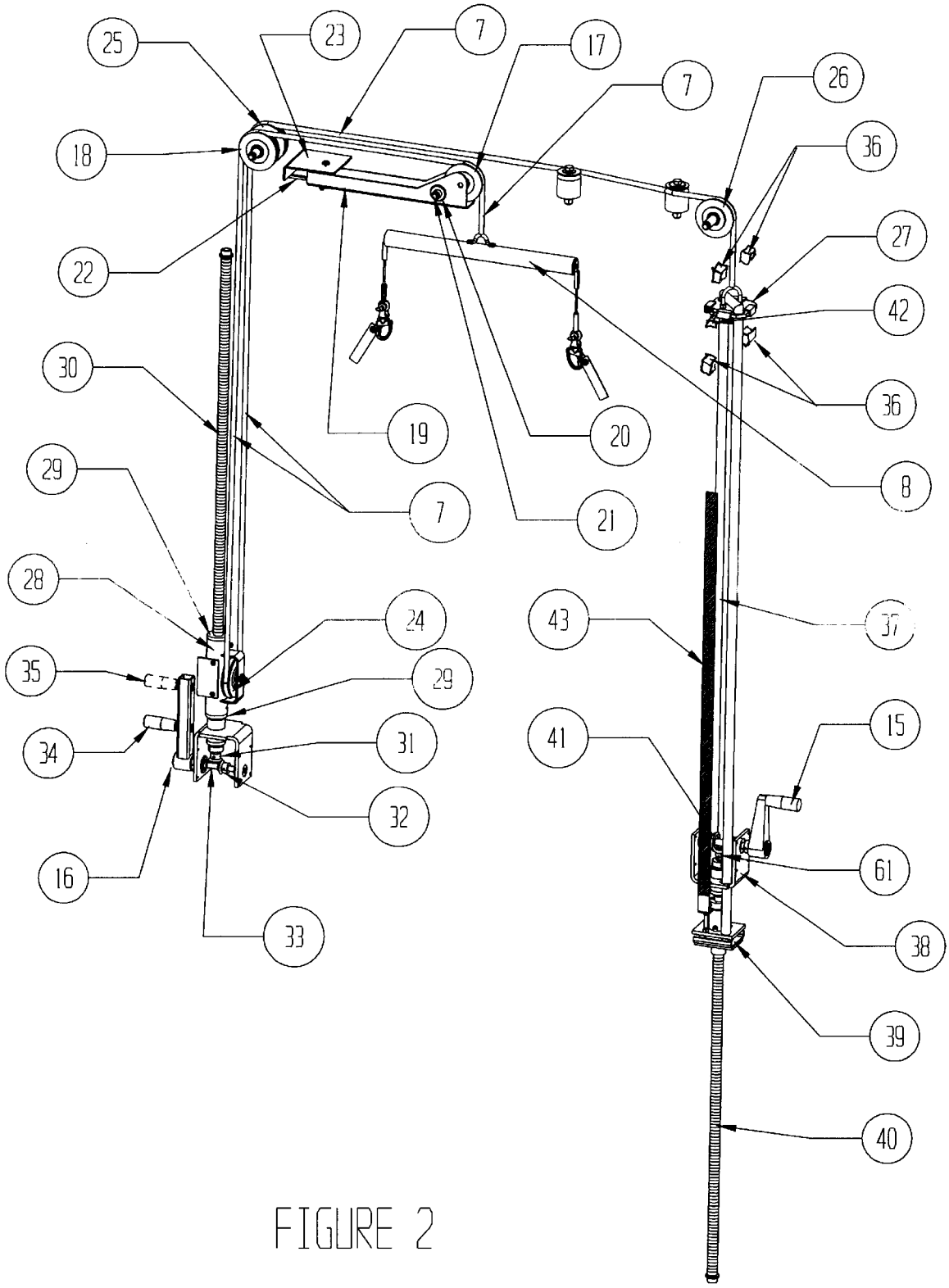
FIG. 2 is a view of the inner mechanism of the weight offloading apparatus.

In FIG. 2 the routing of the rope 7 and the function of the mechanism can be seen. Upon entering into the upper frame 4 the rope 7 runs over a first pulley 17 then onto a second pulley 18. The first pulley 17 is mounted to a lever arm 19. The lever arm 19 is rotatably mounted at one end to a plurality of bearings 20 that are constrained by a pivot shaft 21 fixed to the upper frame 4 (FIG. 1). A bar 22 is fixed to a second end of the lever arm 19. It can be appreciated that when the load is applied to the rope 7 the lever arm 19 will rotate on the bearings 20. The bar 22 presses upon a frame member 23 preventing the lever arm 19 from rotating. It can be appreciated that the bar 22 presses upon the frame member 23 with a force proportional to the force on the rope 7. The proportion is determined by the ratio of the effective lever arm length on either side of the pivot shaft 21. A strain gage is mounted to the bar 22 such that the force applied to the frame 23 by the bar 22 is measured. This measured load is proportional to the load on the rope 7 such that the rope load can be displayed on the load display 12 (FIG. 1) using standard strain gage electronic technology.

The rope is routed along second pulley 18, then downwards along a third pulley 24, then upwards around fourth pulley 25 and across the top side 50 of the upper frame 4 around a fifth pulley 26 which is affixed to the intersection of the top side and a second side of the upper frame 50 then along the second side of the upper frame 4 to the upper guide plate 27 where the rope is terminated and attached. Third pulley 24 is mounted to a first tube 28 with threaded bushings 29 at each end. A first threaded shaft 30 runs through the bushings 29 and runs through bearings at top and bottom ends. At the bottom end of the first threaded shaft a first miter gear 31 is fixed. A second miter gear 32 is meshed with the first miter gear 31 and fixed to a second shaft 33. The second shaft 33 is rotatably mounted in bearings with the height adjusting rotating crank handle 16. It can be seen that when rotating the height adjusting rotating crank handle 16 the threaded shaft 30 is caused to rotate. The tube 28 with threaded bushings 29 is loosely constrained such that it does not rotate with the threaded shaft 29. The rotation of the threaded shaft 29 causes the tube 28 with attached third pulley 24 to move vertically. The height adjusting rotating crank handle 16 thereby causes the third pulley 24 with the rope 7 running therearound to move vertically. Considering the second end of the rope 7 that terminates on guide plate 27 to be fixed, it can be seen that the vertical motion of the third pulley 24 causes a vertical motion of the padded crossbar 8 as the rope 7 runs around the pulleys. It should be appreciated that for a given vertical movement of the third pulley 24 the padded crossbar 8 moves twice as far. In the scope of this invention, the tube 28 carrying fifth pulley 24 can move a maximum of about 28 inches on the threaded shaft 30. Thus the padded crossbar 8 has a maximum vertical movement of about 56 inches to accommodate a vast range of patient sizes.

Height adjusting rotating crank handle 16 has a rotatable knob 34 which the user grasps to turn the height adjusting rotating crank handle 16. The spring loaded rotatable knob 34 has two positions. As shown it has a small radius to rotate through as the handle is turned for the first position. This position is used for fast height adjustments of the padded crossbar 8 under a light load such as when no patient is attached. When a heavy load is present as when assisting a patient out of a wheelchair, the rotatable knob 34 can be moved farther out to position 35. This is accomplished by pulling the spring loaded rotatable knob 34 out of an inner detent, sliding it out along a slot in height adjusting rotating crank handle 16 and dropping it back into an outer detent at position 35. This outer position gives the user much more mechanical advantage to move the padded crossbar 8 with heavy loads.

As stated above the rope 7 terminates and is attached to the upper guide plate 27. The upper guide plate 27 is free to slide vertically within the upper frame 4. Its maximum upper and lower travel is limited by a plurality of fixed stops 36 that are affixed to the upper frame not shown. In this preferred embodiment of the invention the total movement of the guide plate is limited to about 4 inches. This is the general range a patient can move up and down without the load varying excessively. A heavy duty resilient or elastic cord 37 runs through the upper guide plate 27 with both ends of the elastic cord 37 exiting out the bottom surface of the upper guide plate. Both ends of the elastic cord 37 run down passing freely through a mounting bracket 38 and are terminated and attached to lower guide plate 39. It can be seen that as the padded crossbar 8 moves, the rope 27 ultimately makes the upper guide plate move. When the padded crossbar 8 moves down, the upper guide 27 plate moves up. An indicator 42 is attached to the upper guide plate 27 and is visible to the user through the stop window 13 shown in FIG. 1. It can be seen that if a patient attached to the padded crossbar 8 were to fall downward, the upper guide plate 27 would move upward only as far as the upper of the fixed stops 36 allow. Thus the patient is "caught" and can not fall more than a few inches.

The unweighing load is determined by how much the elastic cord 37 is stretched. The lower guide plate 39 has threaded bushings and is mounted to a third threaded shaft 40. A fourth miter gear 61 is meshed with a third miter gear 41 and are affixed to a fourth shaft. The fourth shaft is rotatably mounted to an unweighing load rotating crank handle 15. It can be seen that by rotating the unweighing load rotating crank handle 15 the lower guide plate 39 can be made to move vertically up or down to increase or decrease the tension in the elastic cord 37. The tension in the elastic cord 37 can be varied from zero with the lower guide plate 39 in the uppermost position preferably up to 180 lbs. with the lower guide plate 39 in the lowermost position. A scale 43 configured to display the approximate tension in the resilient cord is attached to lower guide plate 39. The scale 43 is equipped with an indicator label to display the tension that is visible to the user through the approximate unweighing load window 14 (FIG. 1). The scale 43 indicates the position of the lower guide plate 39 and thus the approximate unweighing load range.

The elastic cord 37 is sufficiently long so that a small movement of the upper guide plate 27 caused by the patient moving the padded crossbar 8 up and down while walking does not vary the tension in the cords excessively. Thus normal walking does not vary the unweighing load excessively.

Note that when the elastic cord 37 is tensioned, the upper guide plate 27 is pulled downward against the bottom of the fixed stop 36. It will remain there until a load is placed on the padded crossbar 8.

In use, the approximate unweighing load is set by rotating the unweighing load rotating crank handle 15 until the elastic cord 37 is tensioned to the desired range as indicated on the scale 43 viewed through the window 14. At this point the upper guide plate 27 is pulled against the lower of the fixed stops 36. Next the padded crossbar 8 height is adjusted by rotating the height adjusting rotating crank handle 16 until it is just over the patients head. Next the patient wearing a harness is attached to the padded crossbar 8. The padded crossbar 8 is raised by rotating the height adjusting rotating crank handle 16 until tension starts to develop in the rope 7. The user continues to crank the height adjusting rotating crank handle 16 but the padded crossbar 8 will eventually stop moving up.

Instead, the upper guide plate 27 will be pulled up off the lower fixed stop 36. Now the tension in the elastic cord 37 is transferred to the rope 7 and thus to the patient. The load now may be measured through the strain gage on the bar 22 and displayed on the unweighing load display 12. The height adjusting rotating crank handle 16 is turned until the upper guide plate 27 is centered between the fixed stops 36. This is shown by the indicator 42 in the stop window 13. At this point the unweighing load can be finely adjusted by again turning the unweighing load rotating crank handle 15.

Figure 3:
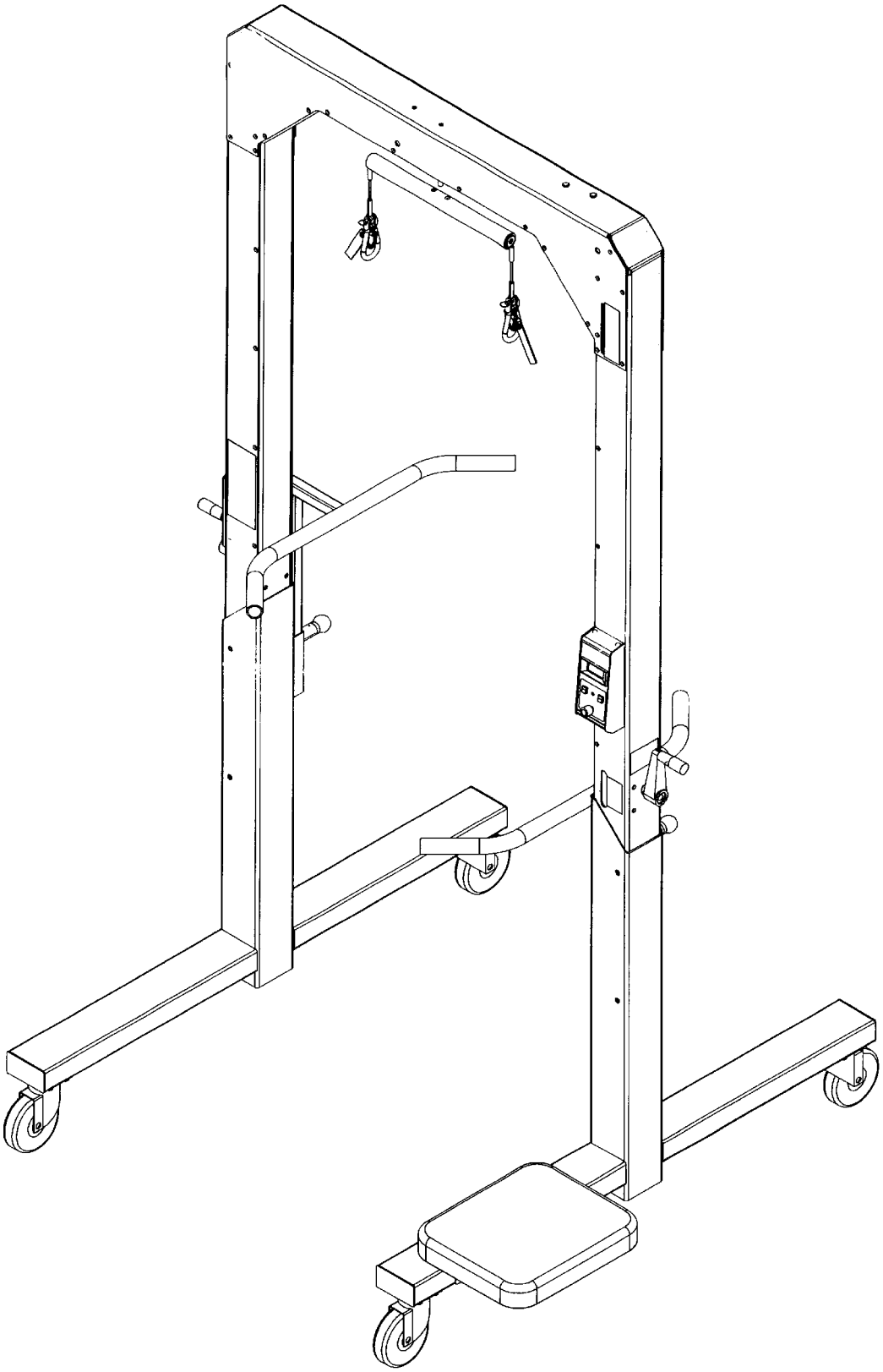
FIG. 3 is an overall view of the weight offloading apparatus with a seat.

In addition, the frame may be equipped with a releasable seat (FIG. 3) mounted to the frame to allow a therapist to be seated while administering therapy. Alternatively, the seat may be collapsible mounted to the frame as well.

Figure 4:
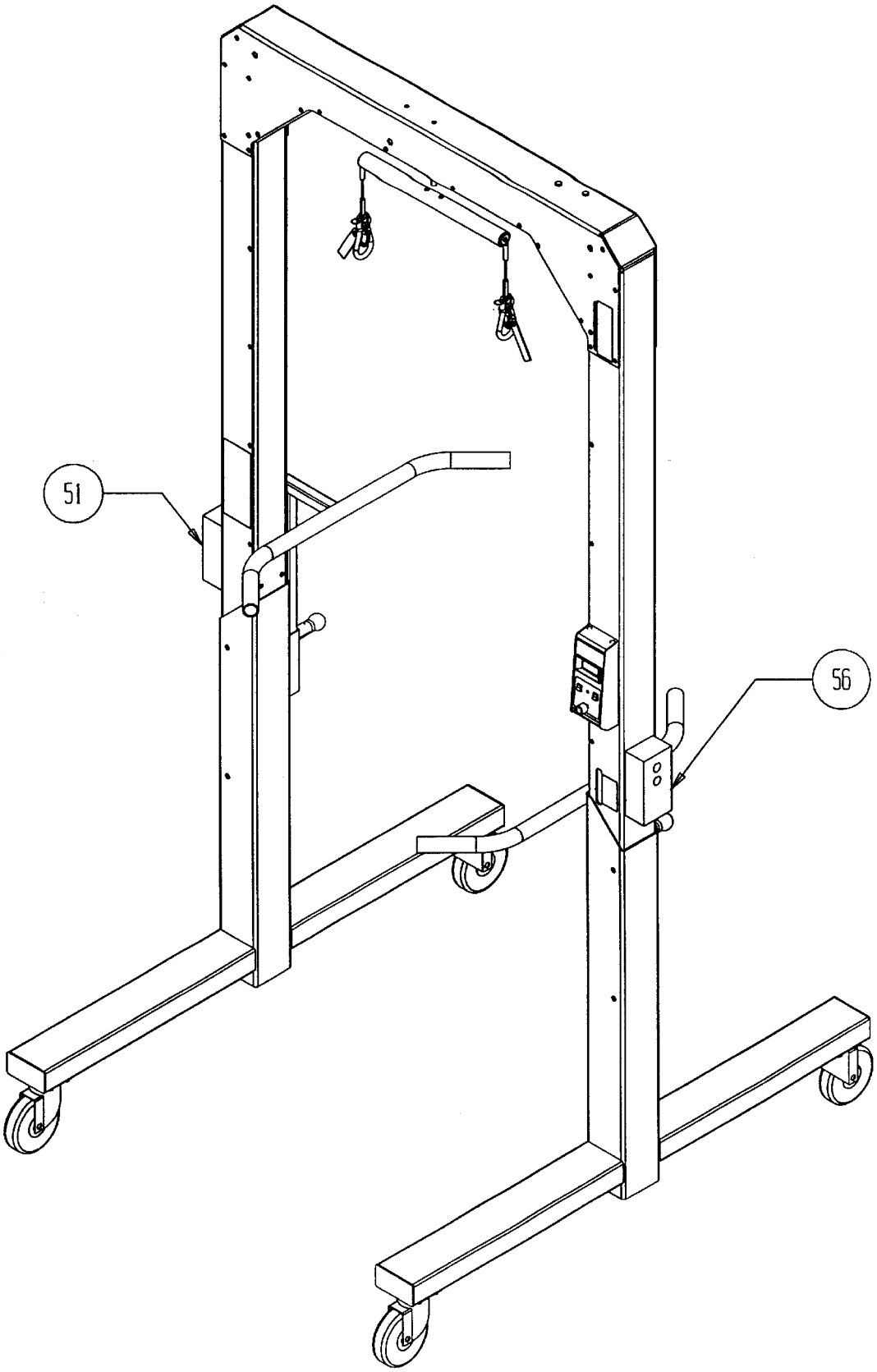
FIG. 4 is a view of the inner mechanism of the weight offloading apparatus with motorized drives.

The functions of the crank handles 16, 15 may be supplemented by a motorized drive 51 (FIG. 4) that may operate either independently or as a replacement for the crank handles. The motorized drive 51 would be preferably battery powered. Otherwise, if powered from a wall socket, movement of the entire unit would be hampered since the power cord might get in the way or restrict such movement. Even if motorized, the unit should still have the crank handles to cover the possibility of power outage.

One motorized drive 51 (FIG. 4) may be provided to move the crossbar 8 relative to the frame in the same way that turning the height adjusting rotating crank 16 may be turned to effect the same relative height adjustment. Such a height adjusting rotating crank 16 and the motorized drive may be considered height adjustors. A further motorized drive 56 (FIG. 4) (preferably battery powered) may be provided to supplement the function of the unweighing load rotating crank handle 15, or in its stead, by driving the lower guide plate 39 to increase or decrease the tension in the elastic cord 37 in the same manner that turning the unweighing load rotating crank handle 15 would accomplish such a change. Both the unweighing load rotating crank handle 15 and the further motorized drive may be considered tension adjustors.

What is claimed is:

1. An offloading weight apparatus, comprising:

a frame having connection linkage;

a rope;

a resilient cord having one end attached to the frame and another end connected to an end of the rope via the connection linkage;

a series of pulleys spaced apart from each other and arranged so as to be supported by the frame, the rope being wrapped about successive ones of the pulleys in the series;

a harness support assembly secured to another end of the rope; and a tension adjustor that applies tension to the resilient cord commensurate with weight to be offloaded, wherein the connecting linkage includes a guide element that is arranged to move in unison with the rope, the rope being arranged to move in response to weight forces exerted by a weight held by a harness that is supported by the harness support assembly, further comprising stops arranged to block the guide element and thereby the rope from moving beyond a fixed distance in response to the weight forces.

2. The offloading weight apparatus as in claim 1, wherein the tension adjustor is a crank that is arranged to be rotatable in one direction to increase tension on the resilient cord and arranged to be rotatable in an opposite direction to reduce tension on the resilient cord.

3. The offloading weight apparatus as in claim 2 wherein the height adjustor is a crank that is rotatable in one direction to increase the height of the crossbar relative to a base of the frame and rotatable in the other direction to decrease the height of the crossbar relative to the base of the frame.

4. The offloading weight apparatus as in claim 2 wherein the tension adjustor also includes a motorized drive.

5. The offloading weight apparatus as in claim 2 wherein the tension adjustor also includes a battery operated motorized drive.

6. The offloading weight apparatus as in claim 1, further comprising a crossbar connecting to said harness support and a height adjustor connected to said frame, said adjustor configured and arranged to be actuated to create relative movement between the crossbar and the frame such that the height of the crossbar varies in response to actuation of the height adjustor.

7. The offloading weight apparatus as in claim 1, wherein the harness support assembly includes an elongated horizontal support having a longitudinal axis and opposite ends and fasteners extending from each of the ends so that a harness may be secured to each of the fasteners at the same time, the rope permitting free rotation about a center region of the horizontal support about an axis that is transverse to the longitudinal axis.

8. The offloading weight apparatus as in claim 1, further comprising a seat attached to the frame.

9. The offloading weight apparatus as in claim 1, further comprising an indicator responsive to variations in tension of the resilient cord caused by the tension adjustor to make an indication of a value that reflects the variations in tension.

10. The offloading weight apparatus as in claim 1, wherein said frame contains aluminum.

11. The offloading weight apparatus as in claim 1 further comprising a plurality of handles mounted on said frame, said handles being configured and arranged to permit a user to grasp said handles to move the frame along a floor surface.

12. The offloading weight apparatus as in claim 1 further comprising a battery operated load display on said frame, said display being configured and arranged to display the offloading weight load based on the degree to which the resilient cord is stretched.

13. The offloading weight apparatus as in claim 1 wherein the tension adjustor is a motorized drive.

14. The offloading weight apparatus as in claim 1 wherein the tension adjustor is a battery operated motorized drive.

15. An offloading weight apparatus as in claim 1, further comprising:

roller locking casters connected to said frame and arranged to aid in moving the frame along a floor surface.

16. An offloading weight apparatus comprising:

a frame;

a lever arm pivotally connected at one end to said frame;

a first pulley coupled to another end of said lever arm;

a series of pulleys spaced apart from each other and arranged so as to be supported by the frame, the rope being engaged with successive ones in the series;

an upper guide plate being moveable along said frame;

a lower guide plate coupled to said frame at a location beneath said upper guide plate;

a rope emerging at one end from the first pulley and being attached to a crossbar having a longitudinal axis to allow said crossbar to rotate about a center region of said crossbar about an axis that is transverse to the longitudinal axis; said rope engaging each one of said series of pulleys and said rope configured and arranged to move in unison with said upper guide plate; an adjusting assembly coupled to said frame configured for adjusting the height of the crossbar; and a resilient cord extending between said upper guide plate and said lower guide plate; a second adjusting assembly configured and arranged to vary the distance between the upper guide plate and the lower guide plate; said resilient cord changing its length in response to the change in distance between the upper guide plate and the lower guide plate.

17. The offloading weight apparatus as in claim 16 further comprising a plurality of handles mounted on said frame.

18. The offloading weight apparatus as in claim 16 further comprising a seat mounted to said frame.

19. The offloading weight apparatus as in claim 16 wherein said frame is contains aluminum.

20. The offloading weight apparatus as in claim 16 further comprising a first rotating handle connected to said adjusting assembly and being configured and arranged to vary the height of the crossbar in response to the rotation of the rotating handle.

21. The offloading weight apparatus as in claim 16 wherein said adjusting assembly includes a motorized drive.

22. The offloading weight apparatus as in claim 16 wherein said adjusting assembly includes a battery operated motorized drive.

23. The offloading weight apparatus as in claim 16 wherein said adjusting assembly is a motorized drive.

24. The offloading weight apparatus as in claim 16 wherein said adjusting assembly is a battery operated motorized drive.

25. The offloading weight apparatus as in claim 16 wherein said second adjusting assembly further comprises a rotating handle configured and arranged to change the relative distance between the upper guide plate and the lower guide plate in response to rotating the handle.

26. The offloading weight apparatus as in claim 16 wherein said second adjusting assembly also includes a motorized drive.

27. The offloading weight apparatus as in claim 16 wherein said second adjusting assembly also includes a battery operated motorized drive.

28. The offloading weight apparatus as in claim 16 wherein said second adjusting assembly is a motorized drive.

29. The offloading weight apparatus as in claim 16 wherein said second adjusting assembly is a battery operated motorized drive.

30. The offloading weight apparatus as in claim 16 further comprising a plurality of fixed stops mounted on said frame and arranged to limit the movement of said upper guide plate along said frame.

31. The offloading weight apparatus as in claim 16 further comprising a load display mounted on said frame for reading the offloading weight load on the rope.

32. The offloading weight apparatus as in claim 16 further comprising a battery operated load display mounted on said frame for displaying the offloading weight load on the rope.

33. The offloading weight apparatus of claim 16 further comprising a plurality of roller locking casters mounted to said frame for aiding in moving the frame along a floor surface.

34. The offloading weight apparatus as in claim 16 further comprising a plurality of cables with release shackles attached to said crossbar for attaching to a harness worn by a patient undergoing gait training.

35. The offloading weight apparatus as in claim 16 further comprising a plurality of pushing handles each mounted to said frame and being configured to cooperate with an engaging member of said frame to allow said handles to be secured to any one of a plurality of locations on said frame.

36. The offloading weight apparatus as in claim 16 wherein the frame includes a window overlaying said upper guide plate to permit viewing of said upper guide plate through said window.

37. The offloading weight apparatus as in claim 16 further comprising a scale assembly connected to said lower guide plate and having an indicator configured to indicate a tension measurement on said resilient cord; and an approximate indicator window overlaying the indicator to permit viewing the tension measurement indicated.

* * * * *